United States Patent [19]

Holt

[11] 4,190,997

[45] Mar. 4, 1980

[54] MEANS FOR FORMING AN EDGE-PROTECTED CONTRACTION JOINT

[76] Inventor: Billie E. Holt, Rte. 1, Box 427, Graham, N.C. 27253

[21] Appl. No.: 936,563

[22] Filed: Aug. 24, 1978

[51] Int. Cl.[2] ..... E04B 1/62

[52] U.S. Cl. ..... 52/396; 404/68

[58] Field of Search ..... 52/396; 404/68, 69, 404/47, 51, 52

[56] References Cited

U.S. PATENT DOCUMENTS

| | | | |
|---|---|---|---|
| 1,704,812 | 3/1929 | Trevisan | 404/68 |
| 1,880,725 | 10/1932 | Bleck | 404/48 |
| 3,068,763 | 12/1962 | Harza | 52/396 X |
| 3,331,176 | 7/1967 | Washam | 52/396 X |
| 3,900,271 | 8/1975 | Crone | 404/68 |
| 4,128,358 | 12/1978 | Compton | 52/396 X |

*Primary Examiner*—Carl D. Friedman

*Attorney, Agent, or Firm*—Joseph H. Heard

[57] ABSTRACT

First and second elongate members formed of wear-resistant metal are embedded within the upper portion of the concrete, while the same is in a plastic condition, at a location where a contraction joint is desired. The members are so connected to each other and to the concrete as to be maintained in substantially parallel abutting relationship pending curing of the concrete and contraction-separation of the sections thereof disposed upon opposite sides of the members, and so as to then undergo lateral movement away from each other and remain in edge-protecting confronting relationship to respective ones of the separated concrete sections. Various types of interconnecting means may be employed for maintaining the members in abutting relationship to each other pending curing of the concrete. These include ones which frictionally interconnect the members, which resiliently bias the same toward each other, and/or which bond the members together in a non-permanent manner.

7 Claims, 4 Drawing Figures

MEANS FOR FORMING AN EDGE-PROTECTED CONTRACTION JOINT

BACKGROUND OF THE INVENTION

This invention relates to contraction joints created in concrete floors and similar monolithic concrete structures which undergo significant shrinkage and contraction-separation upon curing of the concrete of which they are formed. The invention more specifically relates to an improved means for forming a contraction joint which is of small width and whose opposite edges are both protected against spalling.

Concrete floors and similar monolithic structures of the aforesaid type shrink, crack and separate during curing. To prevent such cracking and separation from occurring at random locations within the concrete, it has long been the practice to provide therewithin weakened areas or contraction joints at which contraction-separation of the concrete will occur upon curing thereof. One common way of forming such a contraction joint is by saw-cutting an elongate groove through the upper surface portion of the floor or other concrete structure, after partial curing of the concrete has occurred. Upon further curing, the concrete beneath the groove cracks and the sections of concrete upon opposite sides of a vertical plane extending through the appropriate center of the groove undergo contraction-separation away from each other. The relatively wide space between the separated concrete sections and opposite sides of the groove is then filled with plastic filler material, of which various compositions are commercially available, to complete the contraction joint.

The above-described joint-forming procedure is unsatisfactory in various respects. Sawing grooves within concrete is expensive and tedious work, and requires a return trip to the construction site after the concrete has been poured and allowed to partially cure. If an attempt is made to cut the grooves within the concrete at too early a point in time, the grooves will have undesirably irregular configurations. On the other hand, if too much time is allowed to elapse before the grooves are cut, random cracking and separation of the concrete will occur at locations other than beneath the grooves. Additionally, and perhaps most importantly, the finished contraction joints are relatively wide and do not wear well, particularly when the concrete structure within which they are formed is the floor of a textile mill or similar industrial plant over which there is frequent "traffic" which includes not only pedestrians, but also heavy wheeled vehicles such as fork-lift trucks, dollies, carts, etc. Under such traffic conditions spalling of the opposite upper edges of the construction joints rapidly occurs, even when the joints are filled with plastic filler material.

It has also heretofore been proposed to form a contraction joint by embedding an elongate joint-forming member within the concrete while the same is still in a plastic condition. See, e.g., U.S. Pat. Nos. 1,997,216, 3,023,681, 3,411,260, and 3,555,759. This technique eliminates the above-discussed difficulties inherent in sawing a groove within the concrete after the same has partially cured, but still has not heretofore yielded a finished construction joint which will satisfactorily resist spalling under heavy traffic conditions. Some of the prior-art joint-forming members include a portion or component which is substantially coplanar with the upper surface of the concrete and which upon curing and contraction-separation of the concrete may adhere to and protect the upper edge of one of the two separated concrete sections upon opposite sides thereof. However, the upper edge of the other concrete section remains unprotected after curing and contraction-separation of the concrete, and therefore will undergo spalling when traffic passes over it.

Other prior-art patents of possible relevance to the present invention, although not pertaining to the formation of construction joints of the type presently in question, but rather to the formation of expansion or other types of joints, include the following: U.S. Pat. Nos. 1,001,626, 1,178,700, 1,451,491, 2,405,844, and 3,395,507.

SUMMARY OF THE INVENTION

The present invention provides an improved means for economically and efficiently forming, within a concrete floor or a similar structure which undergoes contraction-separation upon curing of the concrete, a contraction joint whose upper edge portions are both protected and shielded by elongate wear-resistant members which abut and extend along respective ones of such edges throughout their length, and which therefore positively prevent spalling of either of the edges of the joint.

The invention comprises, in accordance with one of its aspects, embedding within the plastic concrete a pair of discrete elongate members having confronting side faces which are maintained in substantially parallel abutting relationship to each other pending curing and contraction-separation of the concrete, and which terminate at the concrete's upper surface. Each of the members is anchored within the respective section of concrete disposed on that side thereof distal from the other of the members. Upon curing of the concrete and contraction-separation of the aforesaid sections thereof, the members undergo relative lateral movement away from each other and remain in fixed, edge-protecting relationship to the ones of the concrete sections to which they are respectively anchored.

In accordance with another of its aspects, the invention provides a joint-forming assembly including a pair of elongate joint-forming members each having anchor means associated therewith, and further including interconnecting means for maintaining the members in abutting relationship to one another pending curing of the concrete within which the members are embedded, while permitting relative lateral movement of the members away form each other with and in response to contraction-separation of the concrete sections disposed upon opposite sides of the members. In a preferred embodiment of the invention, the aforesaid interconnecting means includes connector elements which extend between the two members and prevent relative vertical or longitudinal movement therebetween; and biasing means which maintains or at least assists in maintaining the members in laterally-abutting relationship to each other pending curing of the concrete, while permitting lateral movement of the members away from each other upon contraction-separation of the concrete sections to which the members are respectively anchored. In other embodiments the last-noted function may be performed by the connector elements themselves and/or by means bonding the members together in a non-permanent manner.

DESCRIPTION OF THE DRAWINGS

Other features and benefits of the invention will be apparent from the following description of illustrative embodiments thereof, which should be read in conjunction with the accompanying drawings, in which.

DESCRIPTION OF THE PREFERRED EMBODIMENTS

Figure 1:
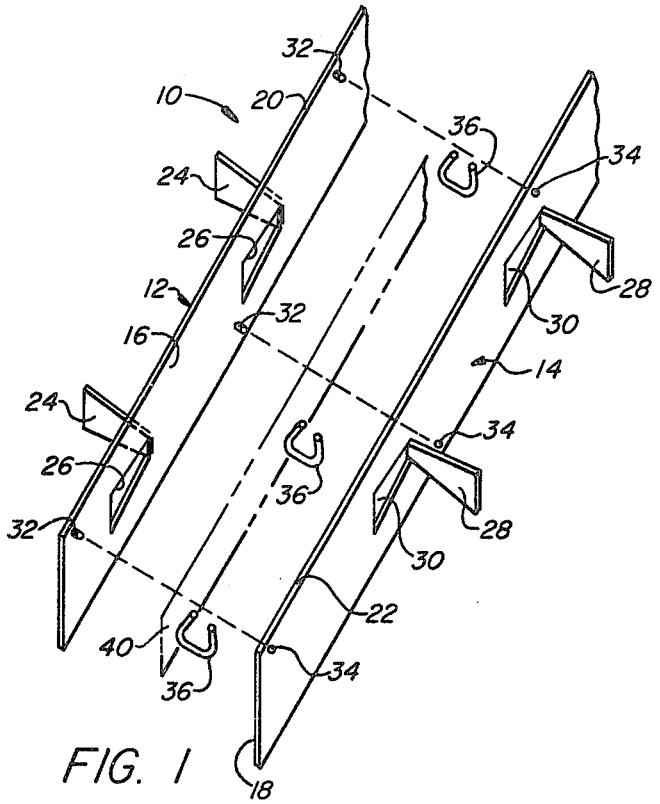
FIG. 1 is an exploded, fragmentary perspective view of a joint-forming assembly constructed in accordance with and adapted for the practice of the present invention.

In FIG. 1 of the drawings the numeral 10 designates a joint-forming assembly which includes first and second elongate members 12, 14, only fragmentary portions of the entire lengths which are shown. Members 12, 14 are formed from flat sections of rigid, wear-resistant material, such as iron or steel, and have confronting and coextensive side faces 16, 18 which extend generally vertically and respectively terminate at upper edges 20, 22 of members 12, 14. Each member 12, 14 further includes, at locations spaced along its length and intermediate its height or vertical dimension, anchor means projecting laterally outwardly from the side thereof distal from the other of the members. Such anchor means comprises, in the case of member 12, a plurality of inwardly-tapering tab-like anchor elements 24 formed by punching and then pressing ninety degrees outwardly sections of the main body portion of member 12. As a result of the aforesaid procedure by which anchor elements 24 are preferably and illustratively formed, the main body portion of member 12 further possesses a plurality of openings 26 at spaced locations along its length and intermediate its height. The other member 14 possesses similarly formed anchor elements 28 and openings 30. However, these are staggered or longitudinally-offset from those of member 12 such that none of the openings 26 of member 12 are laterally aligned with any of the openings 30 of member 14.

Figure 2:
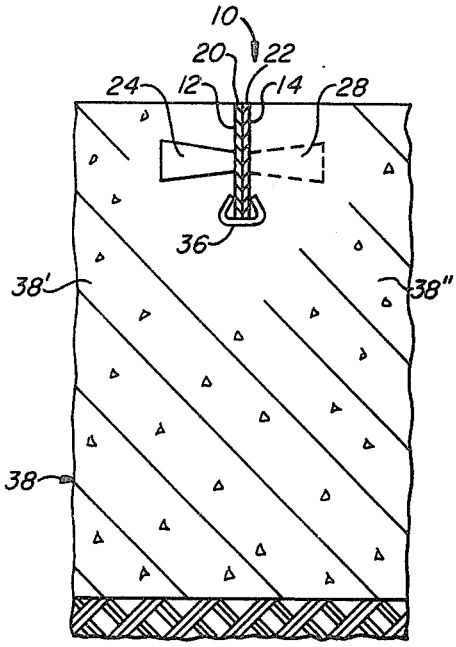
FIG. 2 is a vertical section showing the components of the FIG. 1 assembly in interconnected relationship and embedded within the upper portion of a concrete floor or similar structure which is still in a plastic condition.
Figure 3:
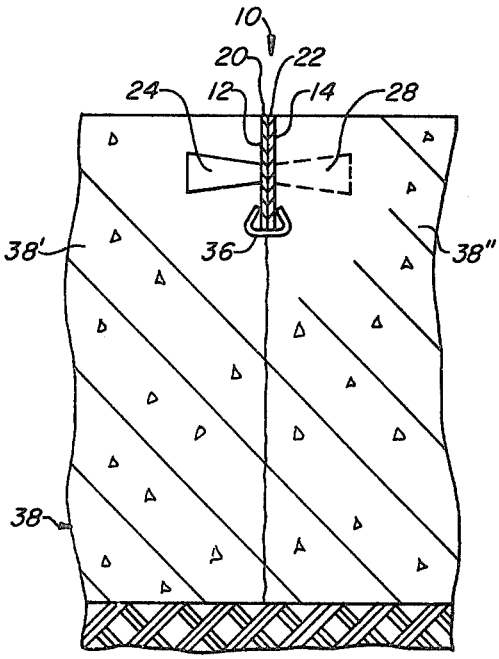
FIG. 3 is a view similar to FIG. 2 but showing the condition existing at that later point in time when cracking of the concrete has occurred.

Assembly 10 also encompasses interconnecting means for temporarily maintaining members 12, 14 in an interconnected relationship, as shown in FIGS. 2 and 3 of the drawings, wherein the confronting inner side faces 16, 18 of members 12, 14 extend in substantially parallel abutting relationship to each other. The illustrated interconnecting means includes, firstly, a plurality of short-length stud-like elements 32 which are fixedly carried by member 12 and which project at spaced locations along its length from upper and lower portions of its side face 16 for reception within laterally aligned ones of a plurality of aligned bore-like openings 34 extending through the main body portion of member 14. Stud-like members 32 and bores 34 are of equal length and their relative diameters are such that once the former are received within the latter, which occurs as members 12, 14 are brought into the aforesaid abutting relationship with each other, any significant vertical or longitudinal displacement of members 12, 14 relative to each other is prevented and bores 34 are in effect "sealed." The aforesaid relationship of their diameters may also be such that the frictional engagement between the confronting cylindrical surface portions of stud elements 32 and bore-like openings 34 prevents lateral movement of the abutting members 12, 14 away from each other under the impetus thereon of a "separating" force of a first magnitude, while permitting lateral movement of the members away from each other under the impetus of a second separating force of larger magnitude. Alternatively or additionally, lateral movement of the abutting members 12, 14 away from each other may be and illustratively is restrained by biasing means in the form of a plurality of generally C-shaped spring elements 36. Elements 36 are secured upon the lower edge portions of members 12, 14, at spaced locations along the length thereof, and by their biasing force maintain or assist in maintaining members 12, 14 in abutting relationship to each other.

After its above-discussed components have been interconnected in the manner described, assembly 10 is embedded within the upper portion of the mass of concrete 38 (FIGS. 2–4) defining the floor or other structure undergoing construction, to a depth such that the upper edges 20, 22 of members 12, 14 are substantially coplanar with the upper surface of the concrete. This is of course done while concrete 38 is still in a plastic condition and, depending upon the concrete's consistency and composition, may in some instances be accomplished simply by forcing assembly 10 downwardly into concrete 38. While this procedure requires application of downwardly-directed forces of considerable magnitude upon assembly 10, the assembly is capable of receiving such forces without separation of its components due to the previously-discussed nature of their interconnection. Alternatively and equally satisfactorily, embedment may be achieved by first forming a "trench" within the upper surface of the plastic concrete 38, placing assembly 10 within such trench, and then causing or allowing re-filling of the trench with plastic concrete. Irrespective of the particular embedment procedure employed, upon completion thereof anchor elements 24 of member 12 will be embedded within the section 38′ of concrete 38 on one side of assembly 10, and the anchor elements 28 of member 16 will be embedded within the section 38″ of concrete 38 upon the opposite side of assembly 10. The plastic concrete of sections 38′, 38″, respectively, will also fill the respective openings 26, 30 of members 12, 14. However, none of the plastic concrete 38 will enter between confronting faces 16, 18 of members 12, 14 due to the abutting relationship then still maintained between such faces, the non-aligned relationship between the openings 26, 30; and the relatively "snug" fit between stud-like members 32 and bore-like openings 34.

Figure 4:
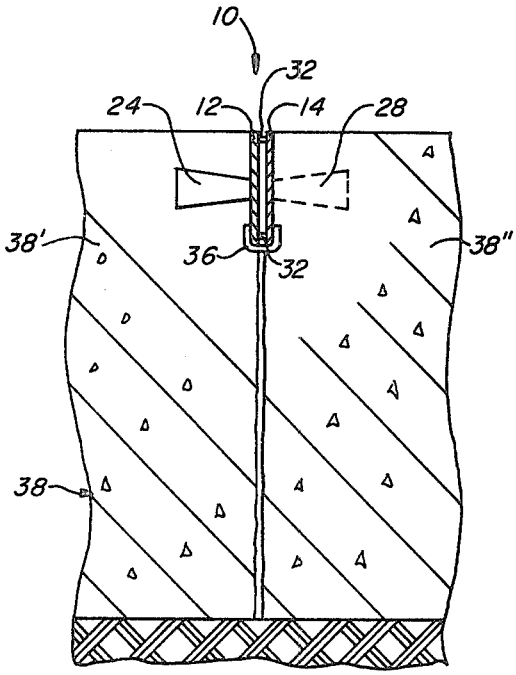
FIG. 4 is a view similar to FIGS. 2 and 3 but showing the condition existing at that still later point in time when contraction-separation of sections of the concrete has occurred.

As concrete 38 cures, it hardens and undergoes shrinkage. The hardening of the concrete about anchor elements 24, 28 firmly secures member 12 to concrete section 38′, and member 14 to concrete section 38″. The shrinkage of concrete 38 first causes cracking thereof along and through its vertically weakened portion directly underlying assembly 10, in a well known manner and as shown in FIG. 3, and thereafter causes contraction-separation of its sections 38′, 38″ away from each other, as shown in FIG. 4. As the aforesaid contraction-separation of concrete sections 38', 38" occurs, members 12, 14 move laterally with the respective ones of the sections to which they are then firmly anchored, and undergo relative lateral movement away from each other. Neither the biasing forces of spring elements 36 or the fictional forces between stud-like elements 32 and bore-like openings 34 are sufficient, either individually or collectively, to prohibit such lateral movement of members 12, 14 away from each other under the impetus of the large-magnitude separating force to which the members are then subjected. The relatively small space between the confronting faces 16, 18 of members 12, 14 in the final contraction joint (FIG. 4) may if desired be filled in a conventional manner with commercially-available plastic filler material. Alternatively, and as shown in FIG. 4, such space may be left vacant since the presence of filler therein material is not required to discourage spalling of the upper edges of either of the concrete sections 38', 38" on opposite sides thereof. This is of course because the uppermost portions of members 12, 14 extend in protective abutting relationship to respective ones of such edges of concrete sections 38', 38" along their entire length, and positively prevent spalling of such edges even under heavy traffic conditions.

In an alternative embodiment of the invention shown by phantom lines in FIG. 1, a thin strip of tape 40 coextensive in length with members 12, 14 may be adhesively secured or bonded to one or both (if the tape has adhesive on both sides thereof) of the side faces 16, 18 of such members. The use of tape 40 eliminates the need for openings 26, 30 of members 12, 14 being in longitudinally-offset, non-aligned relationship to each other, since such tape overlies the aforesaid openings and prevents the plastic concrete 38 from flowing through such openings even when the same are in lateral alignment. Further, if adhesive possessing the requisite bonding strength is present upon both sides thereof, tape 40 may be used in lieu of the previously discussed biasing and/or frictional means to maintain members 12, 14 in abutting relationship to each other until such time as concrete 38 hardens and sections 38', 38" thereof undergo contraction-separation. The same result might also be achieved by other types of bonding. For instance, members 12, 14 might be maintained in parallel abutting relationship to each other pending contraction-separation of concrete 38 by liquid or paste adhesive applied to one or both of the confronting faces 16, 18 of such members; or even by lightly spot-welding such members to one another. Irrespective of the manner in which it might be produced, the bond between members 12, 14 would of course have to be of a sufficiently non-permanent nature as to reliably separate and permit lateral movement of members 12, 14 away from each when concrete sections 38', 38" undergo contractive movement in opposite directions.

While various embodiments of the invention have been specifically shown and described, it is to be understood that this was for purposes of illustration only, and not for purposes of limitation, the scope of the invention being in accordance with the following claims.

That which is claimed is:

1. An assembly for forming an edge-protected contraction joint in a concrete floor or similar structure which undergoes contraction-separation upon curing of the concrete, comprising:

first and second elongate, rigid, wear-resistant metallic members adapted to be embedded within the concrete while the same is in a plastic condition and while the members extend in substantially parallel abutting relationship to each other, and adapted upon curing of the concrete to extend in protective relationship along the length of respective ones of the opposite upper edges of a contraction joint then formed in the concrete by contraction-separation away from each other of first and second sections of the concrete respectively disposed on opposite sides of said first and second members;

each of said members including anchor means extending laterally outwardly from the side thereof distal from the other of said members and into the thereto adjacent one of said concrete sections for, upon contraction-separation of said sections during curing of the concrete, causing each said member to remain in protective engagement with said adjacent one of said concrete sections and to undergo relative lateral movement away from the other of said members;

and interconnecting means for so interconnecting said members as to maintain the same in said abutting relationship to one another while the concrete is in a plastic condition, and as to permit relative lateral movement of said members away from each other during curing of the concrete and in response to then-transpiring contraction-separation of said concrete sections; said interconnecting means including at least one inner-connecting element fixedly secured to one of said elongate members and slidably engageable with the other of said members for preventing vertical and longitudinal relative movement between said members while permitting constrained lateral movement of said members relative to each other.

2. An assembly as in claim 1 wherein said interconnecting means further includes resilient biasing means for imposing biasing forces upon said members sufficient to maintain said members in said abutting relationship to each other while the concrete is in a plastic condition, and insufficient to maintain said members in said relationship upon contraction-separation of said concrete sections.

3. An assembly as in claim 1, wherein said interconnecting means further includes bonding means bonding said members together with a bonding force sufficient to maintain said members in said relationship while the concrete is in a plastic condition, and insufficient to maintain said members in said relationship upon contraction-separation of said concrete sections.

4. An assembly as in claim 1, wherein each of said members has a substantially flat strip-like main body portion having, intermediate its height and at spaced intervals through-out its length, a plurality of laterally-projecting pressed-out sections and resulting openings; said pressed-out sections defining said anchor means, and projecting approximately perpendicularly from said main body portions of said members, and each being of inwardly-tapering shape; and said openings within said main body portion of each of said members being in longitudinally-staggered, non-aligned relationship to said openings of said main body portion of the other of said members.

5. An assembly for forming an edge-protected contraction joint in a concrete floor or similar structure which undergoes contraction-separation upon curing of the concrete, comprising:

first and second elongate, rigid, wear-resistant metallic members adapted to be embedded within the concrete while the same is in a plastic condition and while the members extend in substantially parallel abutting relationship to each other, and adapted upon curing of the concrete to extend in protective relationship along the length of respective ones of the opposite upper edges of a contraction joint then formed in the concrete by contraction-separation away from each other of first and second sections of the concrete respectively disposed on opposite sides of said first and second members;

each of said members including anchor means extending laterally outwardly from the side thereof distal from the other of said members and into the thereto adjacent one of said concrete sections for, upon contraction-separation of said sections during curing of the concrete, causing each said member to remain in protective engagement with said adjacent one of said concrete sections and to undergo relative lateral movement away from the other of said members;

and interconnecting means for so interconnecting said members as to maintain the same in said abutting relationship to one another while the concrete is in a plastic condition, and as to permit relative lateral movement of said members away from each other during curing of the concrete and in response to then-transpiring contraction-separation of said concrete sections; said interconnecting means including first means carried by one of said members and slidably engaging the other of said members for preventing vertical and longitudinal relative movement between said members while permitting relative lateral movement of said members away from each other; and second means for subjecting said members to constraining forces opposing relative lateral movement of the members away from each and of a magnitude sufficient to prevent said relative lateral movement while the concrete is in a plastic condition but insufficient to prevent said movement upon curing of the concrete and contraction-separation of said sections thereof.

6. An assembly as in claim 5, wherein said second means comprises resilient biasing means resiliently biasing said members toward each other.

7. An assembly as in claim 5, wherein said second means comprises bonding means bonding said members to each other.

* * * * *

UNITED STATES PATENT AND TRADEMARK OFFICE

CERTIFICATE OF CORRECTION

PATENT NO. : 4,190,997

DATED : 4 March 1980

INVENTOR(S) : Billie E. Holt

It is certified that error appears in the above-identified patent and that said Letters Patent are hereby corrected as shown below:

Col. 1, line 28, "propriate" should read-- proximate --.
Col. 2, line 50, "form" should read-- from --.
Col. 3, line 29, "lengths which" should read-- lengths of which --.
Col. 5, line 17, "therein material" should read-- material therein --.
Col. 8, line 14, "each and" should read-- each other and --.

Signed and Sealed this

*Third* Day of *June 1980*

[SEAL]

*Attest:*

SIDNEY A. DIAMOND

*Attesting Officer*

*Commissioner of Patents and Trademarks*